United States Patent [19]

Hurwitz

[11] 4,001,972

[45] Jan. 11, 1977

[54] PREFABRICATED PRE-HUNG COMBINATION STORM AND SCREEN DOOR AND METHOD FOR INSTALLING THE SAME

[76] Inventor: Mathew Hurwitz, 63 Oakland Ave., Auburndale, Mass. 02166

[22] Filed: June 9, 1975

[21] Appl. No.: 584,779

[52] U.S. Cl. ..... 49/380; 49/382

[51] Int. Cl.[2] ..... E06B 3/32

[58] Field of Search ..... 49/380, 382, 501, 504, 49/193

[56] References Cited

UNITED STATES PATENTS

| | | | |
|---|---|---|---|
| 2,595,016 | 4/1952 | Spector et al. | 49/380 X |
| 2,930,480 | 3/1960 | Brown | 49/380 X |
| 3,081,852 | 3/1963 | Mendelsohn | 49/504 X |
| 3,226,775 | 1/1966 | Workman | 49/382 |
| 3,383,799 | 5/1968 | Anderson | 49/501 |
| 3,403,490 | 10/1968 | Luedtke | 49/504 X |

*Primary Examiner*—Kenneth Downey
*Attorney, Agent, or Firm*—Arnstein, Gluck, Weitzenfeld & Minow

[57] ABSTRACT

A prefabricated pre-hung combination storm and screen door which may be selectively installed so that the manner of opening may be in a selected direction. The door structure permits reversal of the kick plate from the bottom of the door to the top thereof and the reversal of the other components of the door in correspondingly related positions followed by an inversion in the plane of the door to adapt the door for pivotal movement on the opposite side of the framed opening.

3 Claims, 18 Drawing Figures

PREFABRICATED PRE-HUNG COMBINATION STORM AND SCREEN DOOR AND METHOD FOR INSTALLING THE SAME

BACKGROUND OF THE INVENTION

This invention relates to improvements in prefabricated pre-hung combination storm and screen doors and to a method for installing the same.

Factory assembled pre-hung units, each consisting of a door secured by hinges in a surrounding frame, have been on the market for some time but have not proven entirely satisfactory because in the assembled units as they come from the factory the doors are mounted either for right of left hand swinging. Accordingly, a dealer is required to maintain on hand a stock of two types of doors, one for right hand swinging and the other for left hand swinging, in order to satisfy customer requirements. Such double inventory represents a substantial investment of money. Attempts have been made to solve the problem of double inventory by providing a door and frame combination in unassembled condition, that is, with no holes drilled for the hinges and latch and leaving it to the customer or home owner to drill the holes in the door and in the frame, both for the hinges and for the latch, depending upon which side of the door is to be hinged. This arrangement requires the user to have a certain degree of skill in aligning the parts and use of the tools, which may be beyond the competence and aptitude of the average homeowner, thus, requiring the services of skilled workmen to satisfactorily accomplish the installation.

SUMMARY OF THE INVENTION

In accordance with the present invention, I provide a kit including a door and frame assembly, in which the door is hingedly mounted on one of the jambs of the frame with the opposed jamb being drilled to receive the door latch or with the door latch already installed. The door and frame structure permits the parts to be installed in a framed opening so that the door will swing about one side of the opening, or the parts may be inverted in the plane of the door to adapt the door for pivotal movement on the opposite side of the opening.

One of the objects of the present invention is the provision of a kit containing a pre-hung prefabricated storm and screen door which may be selectively installed so that it may operate either as a right or left door with its hinges located either at the right or at the left of a framed opening.

Another object of this invention is the provision of a prefabricated pre-hung door kit which may be easily installed by the average home owner with a minimum of skill in an existing door opening.

A futher object of this invention is a provision of a prefabricated pre-hung storm and screen door which is substantially complete as it leaves the factory and which without repositioning of the hinges may be hung to swing in a right or left hand direction at the selection of the home owner.

Other and further objects and advantages of this invention will become apparent from the following description when considered in connection with the accompanying drawings.

BRIEF DESCRIPTION OF A PREFERRED EMBODIMENT

Figure 1:
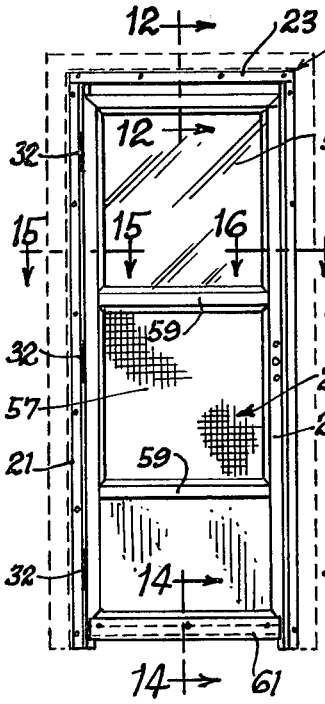
FIG. 1 is an elevational view showing a door and frame assembly embodying the teachings of this invention, in the form in which it would be received by a user. The door is viewed from the outside, is left hinged and opens outwardly.

Referring to FIG. 1, the door and frame assembly 20 is shown in temporarily assembled condition in the form in which it would normally be received by a user in kit form. The assembly 20 includes vertical jambs 21 and 22, a header 23 and a door 24. As will be hereinafter explained, the jambs 21, 22 and header 23 are adapted to be set into the exterior door frame F of a typical house. The door 24 is hingedly connected to the jamb 21 which is disposed on the left side of the assembly such that the door opens from the right hand side and swings outwardly, as viewed from the outside of the door. As received in kit form, the jambs 21 and 22 are of equal length and each extends approximately two inches beyond the top and bottom of the door 24. The extra length of the jambs 21 and 22 is required to accommodate the jambs to a variety of household door frame openings, the heights of which may vary within a prescribed range of sizes.

Figure 15:
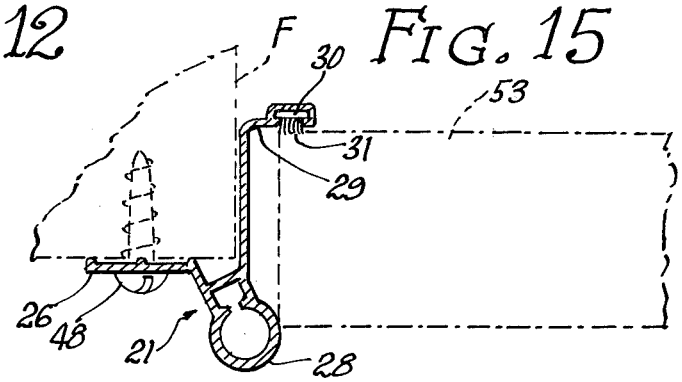
FIG. 15 is a cross-sectional view, on an enlarged scale, taken substantially on line 15—15 of FIG. 1.
Figure 16:
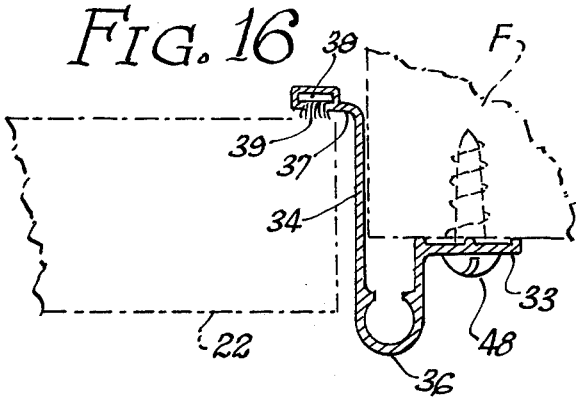
FIG. 16 is a cross-sectional view, on an enlarged scale, taken substantially on line 16—16 of FIG. 1.
Figure 17:
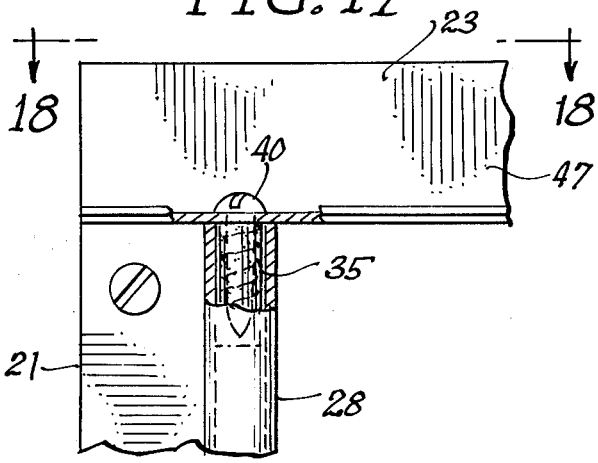
FIG. 17 is a fragmentary elevational view, on an enlarged scale, and partly in cross-section, of a detail.

The jambs 21 and 22 comprise metal extrusions shaped in cross-section somewhat in the form of a Z, substantially as illustrated in FIGS. 15 and 16. The jamb 21 includes a facing flange 26, a side flange 27 disposed at a right angle to flange 21 and a generally tubular portion 28 extending outwardly and angularly at the juncture of the flanges 26 and 27. Flange 26 is provided with a series of spaced holes to receive mounting screws which fasten the jamb 21 to the frame opening. The flange 27 terminates in a stop flange 29 disposed at a right angle to flange 27. Stop flange 29 has a T-shaped channel 30 in which is received a suitable sealing strip 31 against which the door 23 is adapted to abut when in closed position. The tubular portion 28 constitutes one element of the hinge construction and, as illustrated in FIG. 1, is cut away at three spaced points along the length of the jamb 21 to receive cooperating hinge elements 32 which are secured to the door 24 and are arranged to be in registration with the cut-out portions of the jamb. The bores of the tubular portion 28 and of the hinge elements 32 are in axial registration and receive three pintles, not shown, which are secured in a conventional manner and serve to pivotally mount the door 24 to the jamb 21.

The jamb 22 is shaped substantialy as illustrated in FIG. 16 and includes a facing flange 33 and a side flange 34 disposed at a right angle to the facing flange, both flanges being connected by a forwardly extending substantially tubular portion 36. The flange 34 terminates in a stop flange 37 at a right angle to flange 34. Stop flange 37 has a T-shaped channel 38 in which is received a sealing strip 39. In assembled relationship the channels 30 and 38 are substantially coplanar and, in closed position, the door 24 abuts the sealing strips 29 and 39 forming a weather tight seal. The flange 33 is provided with a series of perforations to receive screws by which the jamb 22 is secured to the framed opening F.

Figure 12:
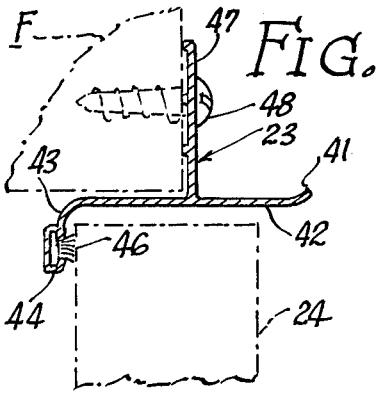
FIG. 12 is a fragmentary cross-sectional view, on an enlarged scale, taken substantially on line 12—12 of FIG. 1.

The header 23 is formed preferably as a metal extrusion generally T-shaped in cross-section, substantially as illustrated in FIG. 12. The forward edge 41 of the horizontal leg 42 is turned upwardly while the rearward edge terminates in a depending stop flange 43 which has a T-shaped channel 44 adapted to receive a sealing strip 46 against which the door 24 abuts in closed position. The vertical leg 47 of the header has substantial height, of the order of 1 ½ to 2 inches, so as to cover any gap which may exist between the top of the door 24 and the frame F. The vertical leg 47 is provided with a series of spaced holes to receive fastening screws 48 which secure the header 23 to the frame F. The horizontal leg 42 is provided at each end portion with a pair of holes, each in registration with a bore of a respective tubular portion 28 or 36. Received in each of the bores is a removable plastic expansion anchor 35 which cooperates with a screw 40 to secure the header 23 to the jambs 21 and 22.

The door 24 is of generally conventional construction and includes a frame comprising a top rail member 51, a bottom rail member 52, a hinge stile 53 and a lock stile 54, all secured together in rigid relationship. Each of the stiles 53 and 54 is provided with at least one longitudinally extending groove, not shown, with the grooves facing each other and being adapted to receive a plurality of components, for example, a pair of window panels 56, a screen 57, a kick plate 58 and a pair of mullions 59 separating these components. Each of these components may be easily inserted in the cooperating grooves, slid therealong and secured in a desired position. Alternatively, the mullions 59 may be permanently fixed in position and spaced so as to divide the open area of the door 24 into three equal unit areas. Correspondingly, the window panel 56, screen 57 and kick plate 58 may be identical in planar area and arranged to be selectively installed in registration with any of said unit areas. These components may be separately packaged and installed in position after installation of the door in a framed opening. A conventional channeled bottom extender 61 is provided for attachment to the bottom rail 52 of the door and its manner of assembly will be more fully explained below. It will also be understood that one of the window panels 56 is conventionally provided to cover the screen 57 and this panel also may be slid into position.

Figure 2:
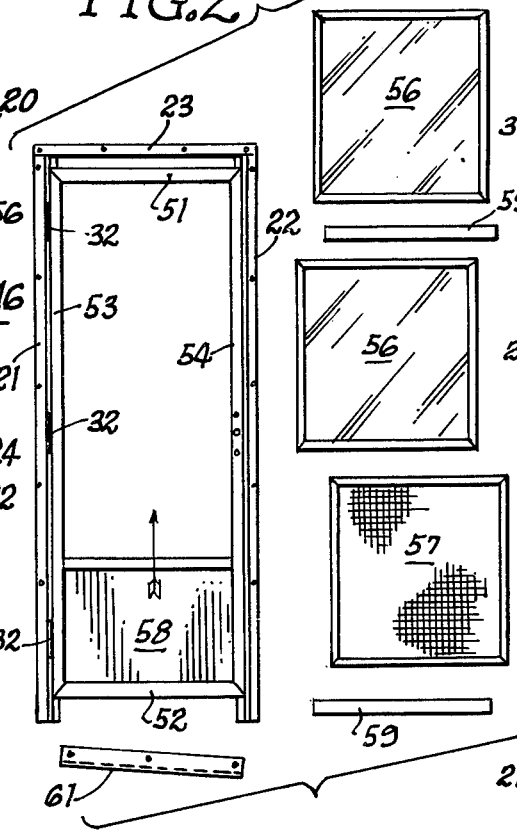
FIG. 2 is an exploded view showing the door and the removable parts thereof in separated relation.
Figure 3:
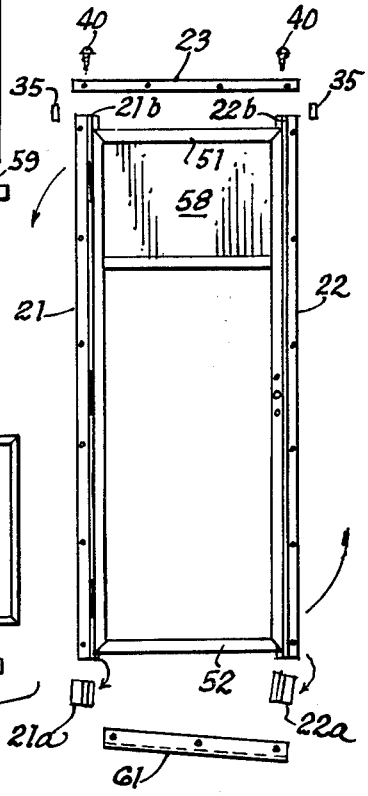
FIGS. 3–6 are more or les diagrammatic views showing the sequence of steps employed in carrying out the method of my invention.
Figure 4:
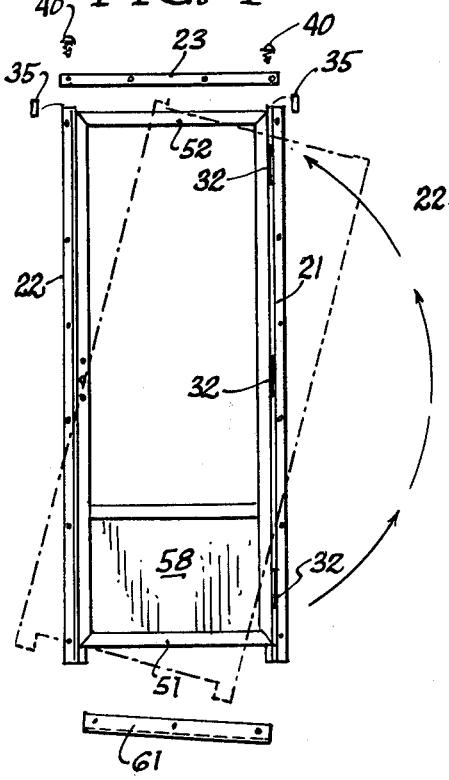
Figure 5:
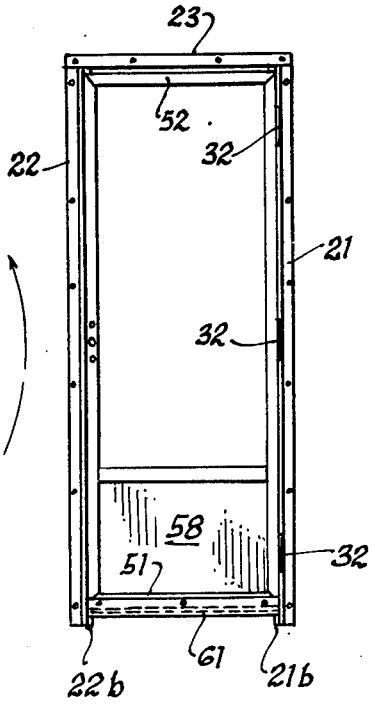
Figure 6:
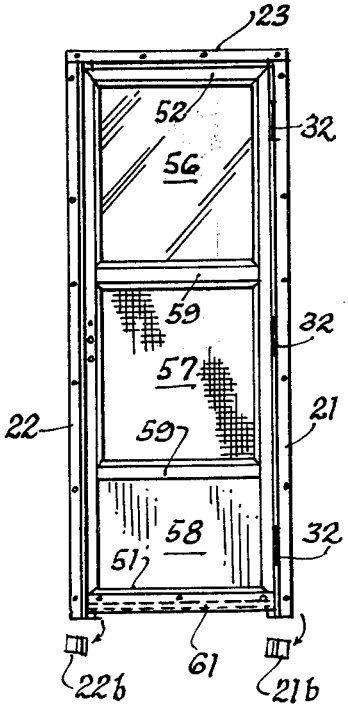

The utility of the invention will now be explained in detail Assuming that upon delivery of the kit to the user in partially pre-assembled condition, as illustrated in FIG. 1, the user finds that a right hinged door is needed which would require positioning the hinges 32 on the right side of the frame F. In such a circumstance, the door assembly 20 is laid on a horizontal surface with the inside of the door facing downwardly. The glass panels 56, screen 57 and upper and lower mullions 59 are then removed, as illustrated in FIG. 2. The kick plate 58 now is slid towards the upper rail 51 followed by one of the mullions 59 and both are secured in position. The header 23 is separated from the jambs 21 and 22 by removing the securing screws 40 and anchors 35. The lower end portions **21*a* and 22*a* of the jambs 21 and 22 are cut off, as illustrated in FIG. 3, so that the ends of the jambs project substantially about ⅛th inch below the bottom rail 52. It will be seen that the upper ends 21*b* and 22*b* of the jambs 21 and 22 extend above the top rail 51 for approximately 2 inches which is the original condition of the assembly, as received. In the next step, the door assembly 20 is inverted or rotated in the plane of the door, as illustrated in FIG. 4, so that the bottom rail 52 now is positioned at the top and the hinge 32 now are disposed on the right hand side of the assembly. The header 23 is then attached to the jambs 21 and 22 by inserting the anchors 35 in the bores of the tubular portions 28 and 36 and securing the header by screws 40 engaged in the anchors 35. The ends 21*b* and 22*b* of the jambs which now are at the bottom of the assembly are cut off to fit snugly within the frame F in which the assembly is to be mounted. The kick plate 58 now is in the lower position and the glass panel 56, mullions 59 and screen 57 then are mounted in the relationship illustrated in FIG. 6 and secured in position. The entire assembly 20 is then positioned within the frame F and secured to the frame by screws 48. Finally, the bottom extender 61 is fitted to the bottom of the door 24** and, after adjustment for proper clearance, is secured in position by screws.

Figure 14:
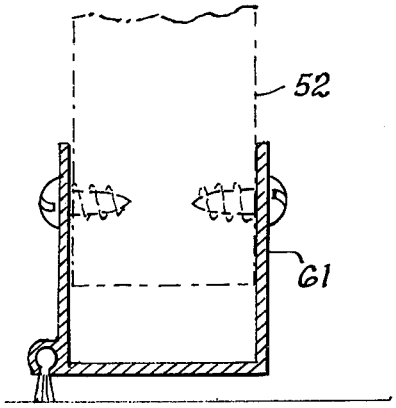
FIG. 14 is a cross-sectional view, on an enlarged scale, taken substantially on line 14—14 of FIG. 1.
Figure 18:
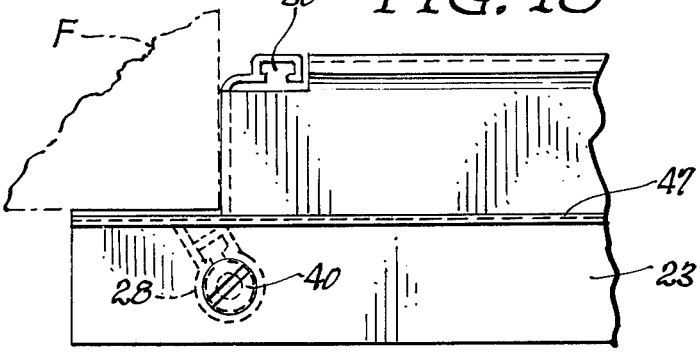
FIG. 18 is a fragmentary top plan view looking in the direction of the arrows on line 18—18 of FIG. 17.

In the event that when the kit is received and it is found that the hinge side is already properly positioned for use by the user, the header 23 is removed, as above explained, and the upper ends **21*b* and 22*b* of the jambs are cut off so that the jambs 21 and 22 extend substantially ⅛ inch above the top rail 51 of the door. The header 23 then is secured in position in the manner, hereinabove described, and the lower ends 21*a* and 22*a* of the jambs then are cut off so that the assembly fits snugly within a frame F and the assembly in secured in position, as hereinabove described. Finally, the bottom extender 61 is secured to the lower end of the door 23 as illustrated in FIG. 14 and assembly of the door 23** to the frame F is now complete.

Figure 7:
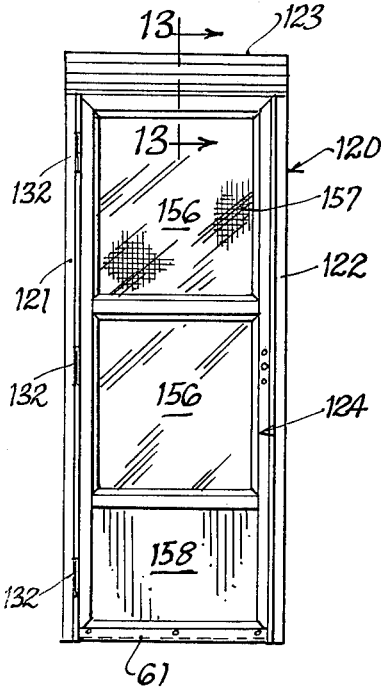
FIG. 7 is an elevational view, similar to FIG. 1, showing a modified embodiment of my invention. The door is viewed from the outside, is left-hinged, and opens outwardly.

In the modified embodiment illustrated in FIGS. 7–11 and 13, the kit includes a pre-fabricated pre-hung door 120, two vertical jambs 121 and 122 and a header bar 123 connecting said jambs at the top. As illustrated in FIG. 7, the door 124 is viewed from the outside and is hinged at the left so that it opens outwardly from the right. Structurally the door and jambs are identical to the corresponding parts, hereinabove described. However, in this instance the jambs 121 and 122 are already pre-cut to be only slightly longer than the height of the door, extending typically ⅛ inch at each end beyond the top and bottom of the door.

Figure 13:
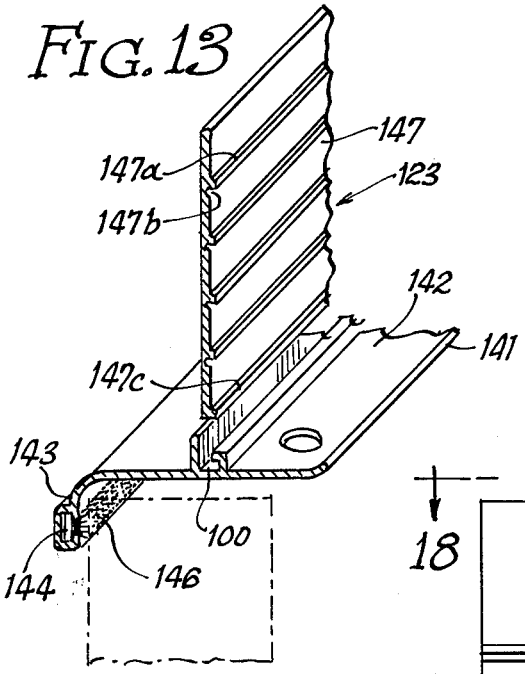
FIG. 13 is a fragmentary perspective exploded view, on an enlarged scale, of a detail, with one end in cross section, such as would be taken substantially on line 13—13 of FIG. 7.

The header 123 employed in this embodiment is illustrated in FIG. 13 and includes a generally horizontal member 142, preferably formed of extruded metal. The member 142 includes an intermediate channel portion 100 formed as an L-slot. The leading edge 141 of the horizontal member 142 is turned upwardly while the rearward edge 143 is bent downwardly and terminates in a T-slot 144 in which is received a sealing strip 146. The header 123 also includes an expander strip which, similarly, is formed of extruded metal, the strip 147 being relatively thin in cross-section and having a series of spaced horizontally extending ribs 147*a* and immediately adjacent each rib a generally V-shaped groove 147*b*. The bottom of the expander strip 147 is provided with a bead 147*c* and, in assembly, as will be hereinafter explained, the expander strip is adapted to be slid endwise into the L-slot 100 and secured in position. Preferably, the expander strip 147 should have a height of approximately three inches with the grooves 147*b* being spaced approximately one half inch (½) apart. It will be understood that the expander strip is frangible along any of the grooves 147*b*.

Figure 8:
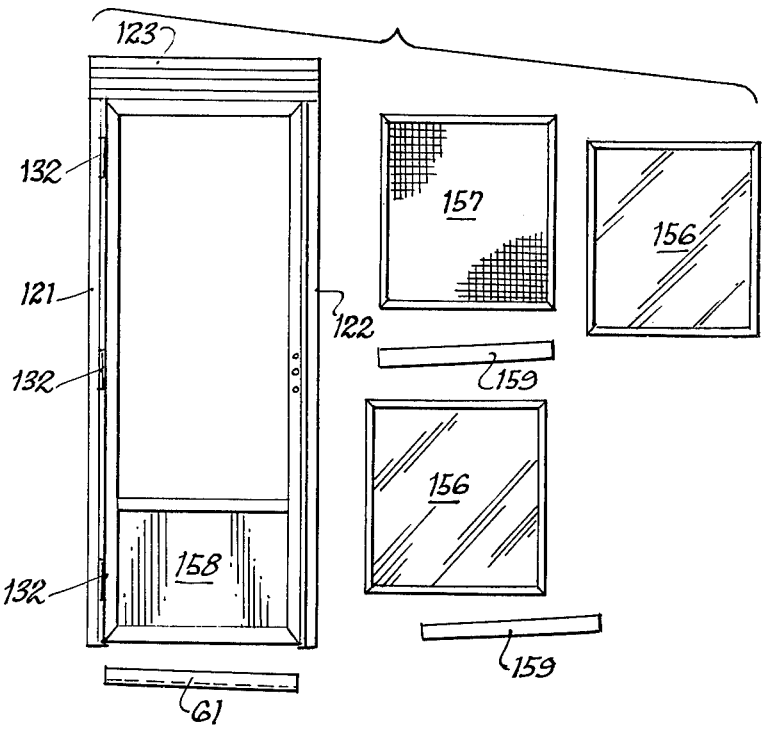
FIG. 8 is an exploded view, similar to FIG. 2, of the modified embodiment shown in FIG. 7.
Figure 9:
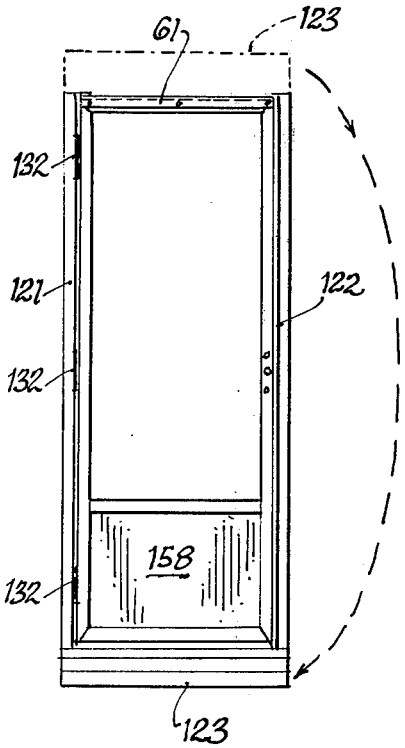
FIGS. 9–11 are more or less diagrammatic views showing the sequence of steps employed in carrying out the method of my invention, in relation to the modified embodiment of FIG. 7.
Figure 10:
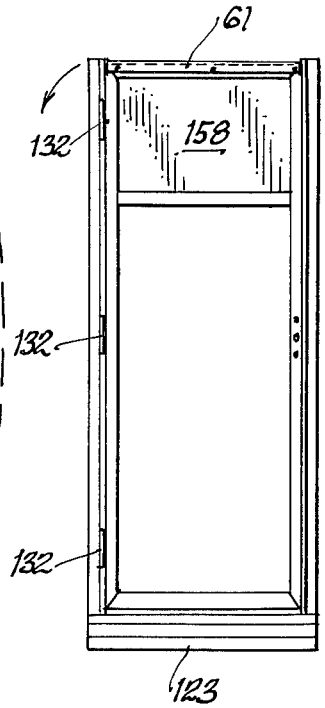
Figure 11:
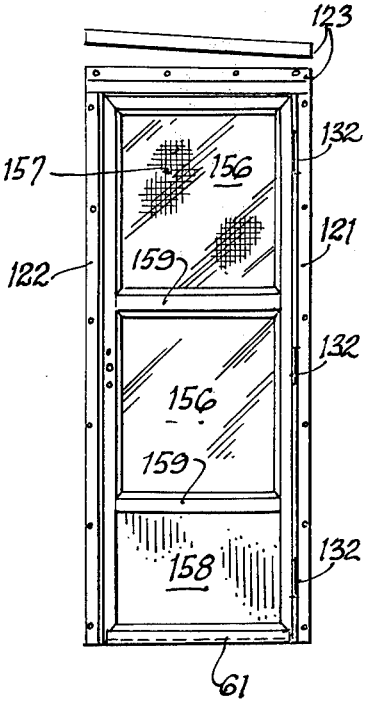

In carrying out the method of my invention in relation to the modified embodiment, if it is desired to reverse the direction of opening, the components of the door namely, the glass panels 156, screen 157 and mullions 159 are removed, as illustrated in FIG. 8, and the header 123 is now moved from the initial position, indicated by the broken lines, to the opposite ends of the jambs, as indicated by the solid lines in FIG. 9. Thereafter, the kickplate 158 is shifted to the upper position illustrated in FIG. 10. The assembly 120 now is inverted so that the header 123 is disposed at the top and the hinges 132 are now on the right side so that the door 124 will open outwardly from the left side.

The assembled door 124 and jambs 121 and 122 are installed in a framed doorway, in the same manner hereinabove described. It will be noted that because the lengths of the jambs 121 and 122 have been pre-cut at the factory, the gap between the top of the header 123 and the frame opening may be greater than that which would be experienced in the installation of the first described embodiment in which the jambs are cut to fit the door frame by the home owner. Accordingly, the expander strip 147 which is provided with the kit is intended to cover such a contigency. The home owner is merely required to measure the existing gap and then break-off the expander strip 147 along one of the grooves 147*b* to provide sufficient coverage for the gap with a certain amount of overlap to permit fastening the overlap to the framed opening.

It will be apparent from the foregoing description that I have provided a simplified storm door kit and a method for installing the same whereby a single kit may be utilized by a home owner with minimum skill to provide a door which may be hingedly mounted on one side or the other to open in a desired direction.

Various changes coming within the spirit of my invention may suggest themselves to those skilled in the art; hence I do not wish to be limited to the specific embodiments shown and described or uses mentiond, but intend the same to be merely exemplary, the scope of my invention being limited only by the appended claims.

I claim:

1. In a pre-hung combination storm and screen door and jamb assembly, a combination comprising a pair of vertical jambs of extruded metal arranged to be mounted in a framed door opening in a building wall, a pre-hung assembly consisting of a door unsymmetrical with respect to its horizontal axis and including a hinge stile and a lock stile with horizontal rail members bridging said stiles adjacent to the upper and lower ends thereof, hinge means permanently connecting said hinge stile to one of said jambs so as to allow the door to open in one direction in relation to one side of said framed opening, said jambs having attachment provisions for the selective attachment of each of said jambs to either side of said framed opening, whereby inversion of said jambs and said door in the plane of the door will locate said hinge means on the opposite side of said framed opening to allow the door to open in an opposite direction, a readily mountable and detachable header member for connection to one end of said jambs and adapted for selective connection to the opposite end of said jambs upon the intended inversion of said jambs and door within the framed door opening, a plurality of movable panels within the door frame adapted to be affixed to said stiles between said horizontal rail members, said panels comprising a kickplate adjacent to said lower rail member, and at least one transverse mullion and panel thereabove extending between said stiles and said upper rail member, means for mounting said kickplate adjacent to said lower rail member or alternatively adjacent to said upper rail member preparatory to the transference of said header member to the opposite end of said jambs, means for fastening said transverse mullion and panel in the door opening beyond said kickplate, and an upwardly facing channel extender mounted between said stiles on said rail member adjacent to said kickplate at the lower portion of the door in both alternate positions thereof.

2. The invention as defined in claim 1, in which the header member is generally T-shaped in cross-section.

3. The invention as defined in claim 1, in which the header member includes a horizontal leg and a vertical leg with said legs being separable.

* * * * *

UNITED STATES PATENT OFFICE
CERTIFICATE OF CORRECTION

PATENT NO. : 4,001,972

DATED : January 11, 1977

INVENTOR(S) : MATHEW HURWITZ

It is certified that error appears in the above-identified patent and that said Letters Patent are hereby corrected as shown below:

Column 2, line 6, "les" should read --less--

Column 4, line 8, "Assuming" should read --assuming--.

Column 4, line 14, "downwardly" should read --upwardly--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*